US007082788B1

(12) United States Patent
Mason

(10) Patent No.: US 7,082,788 B1
(45) Date of Patent: Aug. 1, 2006

(54) SECURE INTERCHANGEABLE CHARM EARRING SYSTEM

(75) Inventor: Harry N. Mason, 26 Lagoria Ct., Alameda, CA (US) 94502

(73) Assignee: Harry N. Mason, Alameda, CA (US)

( * ) Notice: Subject to any disclaimer, the term of this patent is extended or adjusted under 35 U.S.C. 154(b) by 0 days.

(21) Appl. No.: 10/806,739

(22) Filed: Mar. 23, 2004

Related U.S. Application Data

(63) Continuation of application No. 10/097,229, filed on Mar. 13, 2002, now abandoned.

(51) Int. Cl.
*A44C 7/00* (2006.01)

(52) U.S. Cl. ..... 63/13; 63/12; D11/41; D11/78

(58) Field of Classification Search ..... 63/12, 63/13, 3, 3.2, 21, 23, 26, 29.1, 14.1; D11/41, D11/78

See application file for complete search history.

(56) References Cited

U.S. PATENT DOCUMENTS

| | | | | | |
|---|---|---|---|---|---|
| 148,390 | A | * | 3/1874 | Tappan | 63/13 |
| 528,197 | A | * | 10/1894 | Woglum | 63/12 |
| 2,629,989 | A | * | 3/1953 | McDonald | 63/13 |
| D175,867 | S | * | 10/1955 | Sutain | D11/86 |
| 3,071,938 | A | * | 1/1963 | Davidson | 63/13 |
| 4,221,118 | A | * | 9/1980 | Chicckine | 63/13 |
| 4,497,186 | A | * | 2/1985 | Mason | 63/13 |
| 4,741,179 | A | * | 5/1988 | McConnell, Jr. | 63/13 |
| D344,910 | S | * | 3/1994 | Nelson | D11/79 |
| D368,671 | S | * | 4/1996 | Ross | D11/78 |
| 5,809,803 | A | * | 9/1998 | Stracuzzi | 63/12 |

FOREIGN PATENT DOCUMENTS

GB 002274236 A * 7/1994

* cited by examiner

*Primary Examiner*—Katherine Mitchell
(74) *Attorney, Agent, or Firm*—Fulwider Patton LLP

(57) ABSTRACT

A secure interchangeable charm earring system, for use with pieced ears, includes an earring body from which a charm hangs. Numerous charms having different ornamental forms can be interchanged on the earring, each having a charm opening. The earring has a body having a free end, a blocked end larger than the charm opening, and an apex portion therebetween. A spiraling middle portion extends between the apex portion and the free end, and a vertical piece extends between the apex portion and the blocked end. When the charm is brought into contact with the blocked end, the charm is not permitted to pass over the blocked end. When the earring is in place within the pieced ear hole, the earring hangs down from the pieced ear, with the apex portion extending through the hole. The charm is then maintained securely on the earring between the blocked end and the pieced ear.

6 Claims, 4 Drawing Sheets

SECURE INTERCHANGEABLE CHARM EARRING SYSTEM

CROSS REFERENCES AND RELATED SUBJECT MATTER

This application is a continuation of patent application Ser. No. 10/097,229, filed in the United States Patent Office on Mar. 13, 2002 now abandoned.

BACKGROUND OF THE INVENTION

The invention relates to a secure interchangeable charm earring system. In particular, the invention is an earring that is intended for use with a pieced ear, wherein a charm may be quickly and easily placed on the earring.

Earrings are a popular accessory worn by people of all age groups. Hangings earrings have become popular and allow the wearer a greater design choice. Because of the configuration of most earrings, however, the wearer is limited to the particular design of the piece of jewelry. The construction of a typical earring does not allow a charm or pendent to be added.

Thus, there exists a need for an earring on which a charm may be added and secured. Such an earring should be equipped with a blocked end in order to secure the charm in place on the earring when worn through a pieced ear.

My previous patent, U.S. Pat. No. 4,497,186, discloses an earring with a pendent and a circumjacent spiral portion. The earring hangs down from the pierced hole but does not allow for a charm to be added thereto.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved secure interchangeable charm earring system. As such, the general purpose of the present invention, which will be described subsequently in greater detail, is to provide a new and improved secure interchangeable charm earring system which has all the advantages of the prior art and none of the disadvantages.

To attain this, the present invention essentially comprises a secure interchangeable charm earring system, for use with pieced ears, includes an earring body from which a charm hangs. Numerous charms, each having a charm opening, but having different ornamental forms can be interchanged on the earring. The earring has a free end, a blocked end, and a length of material extending therebetween. The earring also has an apex portion, a spiraling middle portion extending between the apex portion and the free end, and a vertical piece extending between the apex portion and the blocked end. When the charm is brought into contact with the blocked end, the charm is not permitted to pass over the blocked end. When the earring is positioned in place within the pieced ear hole, the earring hangs down from the pieced ear, with the apex portion extending through the hole. The charm is then maintained securely on the earring between the blocked end and the pieced ear.

It is an object of the invention to produce an earring on which a charm may be worn. Accordingly, the earring has a free end and a blocked end. The free end is threaded through the pieced hole, and charm is trapped between the pieced ear and the blocked end.

It is a further object of the invention to produce an earring on which a charm can be quickly and easily interchangeable on the earring, and is secured therein without the need for additional hardware. Accordingly, the charm has a charm opening such as that provided by a charm ring, and the body of the earring is threaded through the charm opening.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
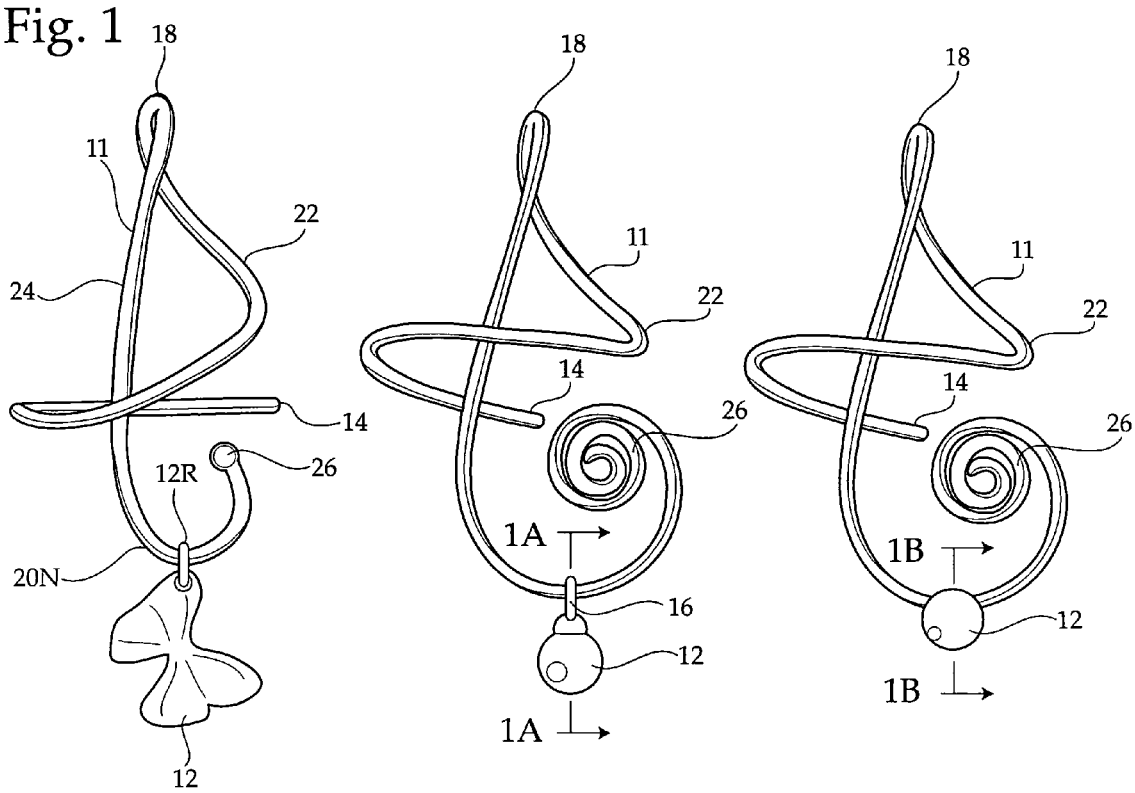
FIG. 1 is a perspective view of three embodiments of the secure interchangeable charm earring system.
Figure 1A:
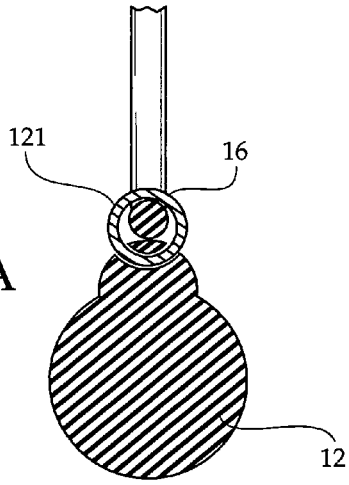
FIG. 1A is a cross sectional view, taken along line 1A—1A of FIG. 1.

10 earring
11 earring body
12 charm
121 charm opening
12R charm ring
14 free end
16 blocked end
18 apex portion
20 curved bottom portion
20V curved bottom portion valley
20H curved bottom portion high point
22 spiraling middle portion
24 vertical piece
26 ball
28 concentric circles
30 pierced ear
32 pieced hole

DETAILED DESCRIPTION OF THE PREFERRED EMBODIMENTS

FIG. 1 illustrates three embodiments of the invention, showing an earring 10 having a charm 12 hanging therefrom. According to the present invention, numerous charms 12, having different ornamental forms, can be interchanged on the earring 10. The earring 10 is for use with a pieced ear 30 having a pierced hole 32. The earring 10 comprises an earring body 11 formed from a single integral piece, said piece having a substantially uniform cross section through its length, and is typically wire-like.

Figure 1B:
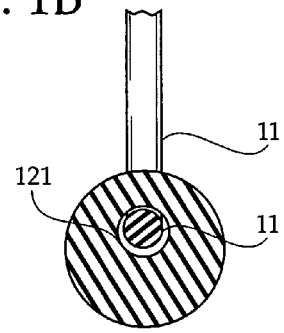
FIG. 1B is a cross sectional view, taken along line 1B—1B of FIG. 1.

The charm 12 may take any form and is placed on the earring 10 before said earring 10 is placed in the ear 30. The charm 12 has a charm opening 121 which may comprise a bore extending through the charm 12, such as the bead illustrated in the embodiment of FIG. 1B. The charm opening 121 may also be provided by a charm ring 12R which is itself secured to the charm. In any case, the charm 12 is secured on the earring 10 by the charm opening 121 that extends around the body 11 of the earring 10. Put another way, the body 11 of the earring 10 is sized to extend through the charm opening 121. The earring 10 may be constructed from a wide variety of materials, namely gold, silver, metal, or plastic.

Figure 3:
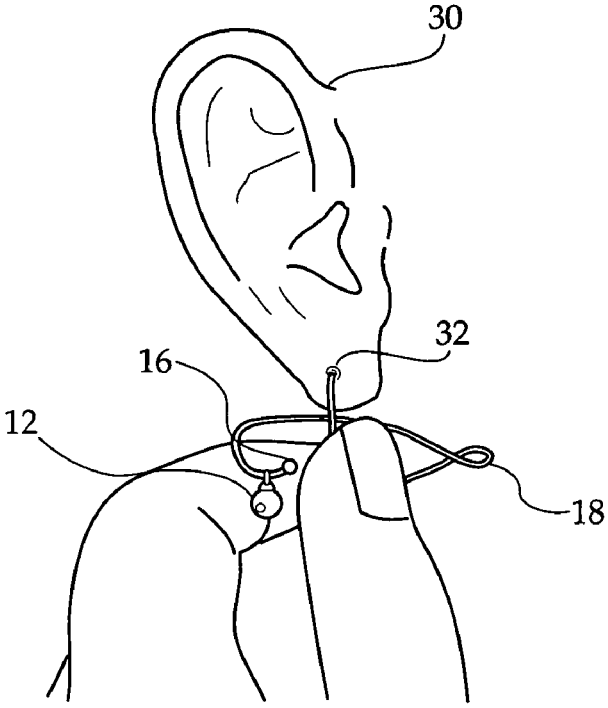
FIG. 3 is a front elevational view of the free end of the earring being fed through the pierced ear.
Figure 4:
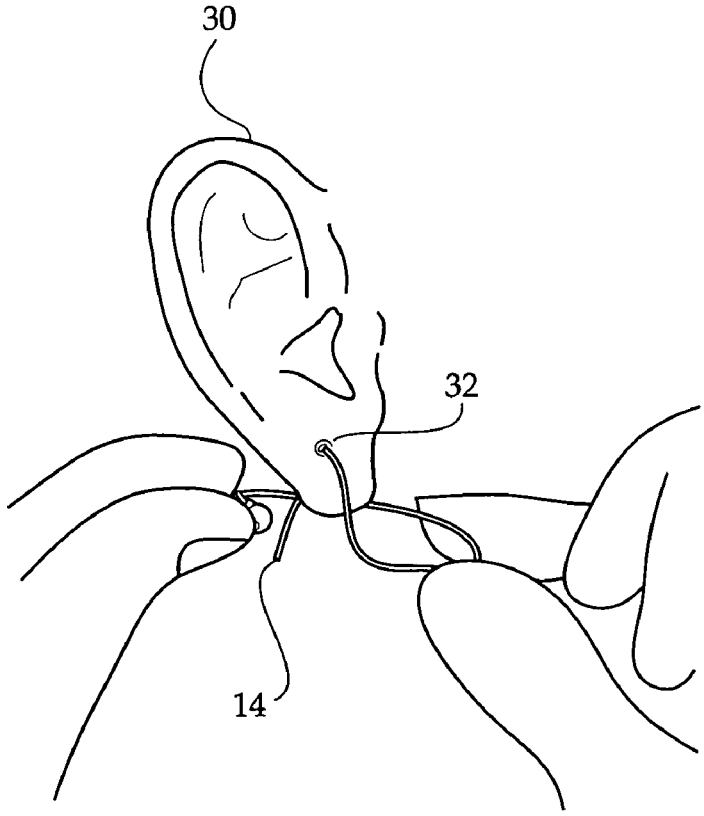
FIG. 4 is a front elevational view of the spiraling middle portion of the earring being fed through the pierced ear.
Figure 5:
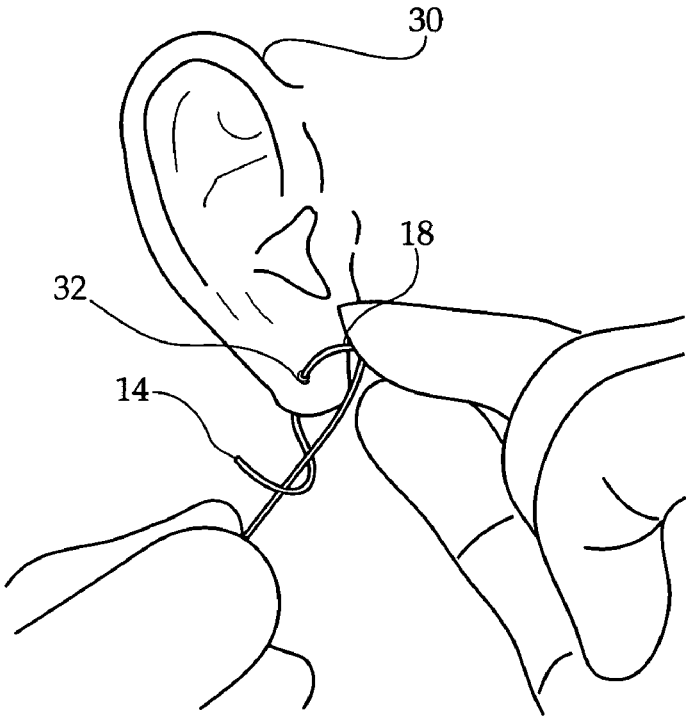
FIG. 5 is a front elevational view of the middle portion of the earring fed further through the pierced ear wherein the earring has been twisted to follow the spiral of the middle portion.

The earring 10 substantially comprises a free end 14, a blocked end 16, and a length of material extending therebetween. The length of material is designed in such a manner as to allow a person to insert the free end 14 into and thread the pierced ear 30, as illustrated in FIGS. 3, 4 and 5. The earring 10 further has an apex portion 18, a curved bottom portion 20, and a vertical piece 24 that extends between the apex portion 18 and the bottom portion 20. A spiraling middle portion 22 extends immediately from the free end 14 and wraps around the vertical piece 24. The curved bottom portion 20 has a valley 20V and a high point 20H.

The free end 14 is located at the end of the middle portion 22 and the blocked end 16 may be positioned below the free end 14, at the curved bottom portion high point 20H. The free end 14 extends into the angled middle portion 22, said middle portion reaching up to the apex portion 18. The vertical piece 24 connects the apex portion 18 and the bottom portion 20. When in place on the earring 10, the charm 12 dangles from the valley 20V of the bottom portion 20.

The blocked end 16 of the earring 10 may take on a variety of embodiments in order to prevent the charm 12 from extending past the blocked end 16, as illustrated in FIG. 1. By one such embodiment a ball 26 is attached at the blocked end 16, said ball having a larger diameter than the charm opening 121, which prevents the charm 12 from extending past the blocked end 16. When the charm ring 12R or charm opening 121 is brought into contact with the blocked end 16, the ring 12R or opening 121 is not permitted to pass over the blocked end 16. Alternatively, the blocked end 16 may be formed into concentric circles 28, with insufficient space between the circles 28 to allow the charm opening 121 to pass. This configuration has the same result as the ball 26, namely preventing the charm ring 12R from escaping off of the earring 10 via the blocked end 16, yet allows the earring to be constructed from a single piece of material.

Figure 2:
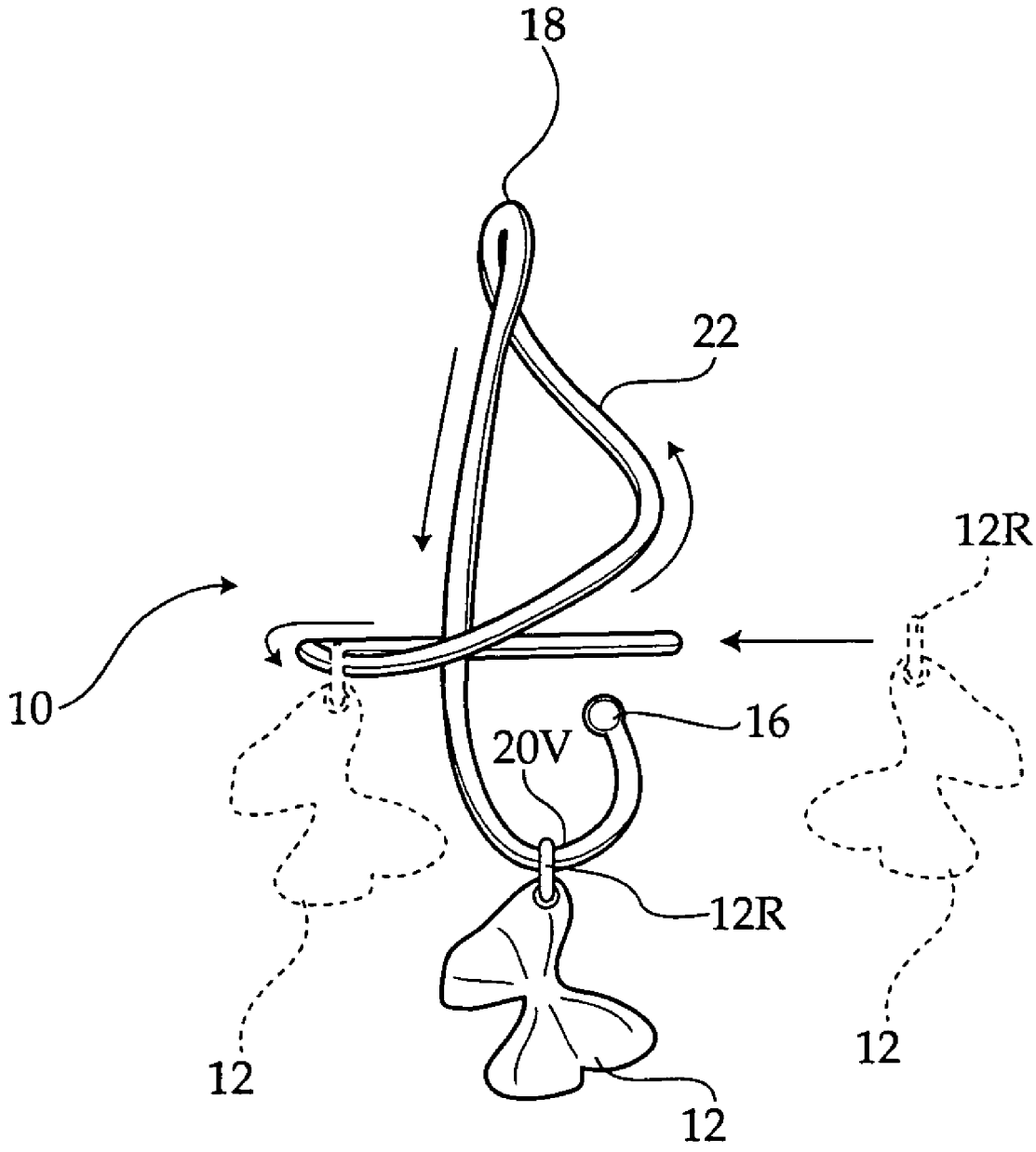
FIG. 2 is a front elevational view of the earring, with the body of the earring being threaded through the charm ring.

In use, the charm 12 is first placed on the earring 10 by passing the earring free end 14 through the charm opening 121 (which may involve passing the free end 14 through the charm ring 12R), as illustrated in FIG. 2. The earring 10 is then threaded through the charm opening 121 by moving the charm 12 along the earring body 11 fully to the blocked end 16. The charm 12 extends over the middle portion 22, up and over the apex portion 18, and down along the vertical piece 24 towards the bottom portion valley 20V. Once the charm 12 is in place and resting in the valley 20V or otherwise near the blocked end 16, the earring 10 is progressively fed through the pieced hole 32, as illustrated in FIGS. 3, 4 and 5. The spiraling middle portion 24 is fed through the hole 32 while twisting the earing until the apex portion 18 reaches said hole 32. The earring 10 hangs down from the pieced ear 30, with the apex portion 18 extending through the hole. The charm 12 is then maintained securely on the earring 10 between the blocked end 16 and the ear 30, without the need for additional hardware.

Figure 6:
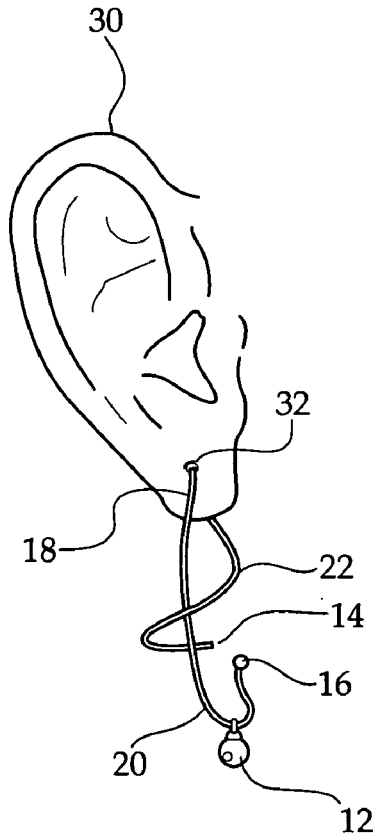
FIG. 6 is front elevational view of the earring in place within the pieced ear, where the apex is located near the pierced hole.

Referring to FIG. 6, the earring 10 having the charm 12 on the body 11 is fully installed on the ear 30. Accordingly, because of the structure of the present invention, the charm 12 may be quickly and easily threaded onto the earring 10. However, once the earring 10 is mounted on the ear 30, the charm 12 cannot be removed from the earring 10. Because the charm cannot be removed in either direction, the charm 12 is prevented from becoming lost, since it is trapped between the ear 30 and the blocked end 16.

In conclusion, herein is presented a system for allowing a charm to be easily interchanged on an earring and maintaining a charm on the earring in a secure manner while the earring is on the ear, without the need for additional hardware. The invention is illustrated by example in the drawing figures, and throughout the written description. It should be understood that numerous variations are possible, while adhering to the inventive concept. Such variations are contemplated as being a part of the present invention.

What is claimed is:

1. A secure interchangeable charm earring system for use with a pierced ear having a pierced hole, the earring having a charm with a charm opening, comprising:

an earring body formed from a single integral piece, said piece having a substantially uniform cross section through its length except at one end, the earring body having:

a top, a bottom and a longitudinal dimension extending between the top and the bottom;

a free end for threading through the pierced ear, the free end sized to allow the free end to extend through the charm opening and the free end extending generally perpendicular to the longitudinal dimension;

a blocked end, said blocked end preventing the charm from being removed from the earring thereat; and an apex portion between the free end and blocked end, the apex portion residing at the top of the earring body;

a vertical portion extending between the apex portion and the blocked end;

a spiraling middle portion extending between the apex portion and the free end wherein the body is sized to allow the charm to move fully from the free end toward the blocked end, such that when the earring body is threaded onto the ear with the apex at the pierced hole, the charm is trapped between the blocked end and the pieced ear; and wherein the free end is positioned longitudinally closer to the top of the earring body than the blocked end and the charm when the earring is worn on the ear.

2. The secure interchangeable charm earring system as recited in claim 1, wherein the charm has a charm ring having the charm opening, and wherein the earring further comprises a ball located at the blocked end that is larger in diameter than the charm ring.

3. The secure interchangeable charm earring system as recited in claim 1, wherein at the blocked end the body is bent to form a plurality of concentric circles which do not allow the charm to pass that portion of the body.

4. The secure interchangeable charm earring system as recited in claim 1, wherein the body further comprises a curved bottom portion, the curved bottom portion having a valley and a high point, the blocked end located at the high portion, wherein the charm rests in the bottom portion valley when in place on the earring.

5. A method of using an interchangeable charm earring, for use with a pierced ear having a hole therethrough, using an earring having an earring body formed from a single integral piece having a substantially uniform cross section through its length, the body further including a top end, a bottom end and a longitudinal dimension between the top and bottom ends and having a free end, blocked end, an apex portion configured at the top end, a curved bottom portion located adjacent the blocked end, a vertical piece extending between the apex portion and the bottom portion, and a spiraling middle portion located between the apex and free end the spiraling middle portion configured around the vertical portion, and using at least one charm, each charm having a charm ring for attaching the charm to the earring, comprising the steps of:

placing the charm on the earring by threading the earring through the charm ring from the free end toward the blocked end;

configuring the free end generally perpendicular to the longitudinal dimension between the top end and the bottom end and longitudinally closer to the top end than the blocked end and the at least one charm;

inserting the earring into the pierced ear by feeding the free end of the earring through the pierced hole while twisting the earring until the apex portion reaches the pierced hole; and securing the charm on the earring by trapping the charm between the ear and the blocked end.

6. The method of using an interchangeable charm earring as recited in claim 5, wherein the step of placing the charm on the earring by threading the earring through the charm ring from the free end to the blocked end, further comprises the steps of:

inserting the free end of the earring through the charm ring; and moving the charm and charm ring over the body around the angled middle portion, past the apex portion, down the vertical piece, to the bottom portion.

* * * * *

UNITED STATES PATENT AND TRADEMARK OFFICE

CERTIFICATE OF CORRECTION

PATENT NO. : 7,082,788 B2
APPLICATION NO. : 10/806739
DATED : August 1, 2006
INVENTOR(S) : Harry N. Mason It is certified that error appears in the above-identified patent and that said Letters Patent is hereby corrected as shown below:

Column 1,
Lines 51, 62, and 65, delete "pieced" and insert --pierced--.

Column 2,
Line 2, delete "pieced" and insert --pierced--.

Column 3,
Line 2, delete "pieced" and insert --pierced--.

Column 4,
Line 48, after "free end" insert --the spiraling middle portion configured around the vertical portion;--.

Signed and Sealed this

Twelfth Day of December, 2006

JON W. DUDAS
*Director of the United States Patent and Trademark Office*